US005828161A

United States Patent [19]

Palyu

[11] Patent Number: 5,828,161

[45] Date of Patent: Oct. 27, 1998

[54] EXTERNAL NEGATIVE ELECTRODE HAVING A CAMBERED SHAPE

[75] Inventor: Ronald L. Palyu, Cleveland, Ohio

[73] Assignee: TLR Innovations, Inc., Cleveland, Ohio

[21] Appl. No.: 727,958

[22] Filed: Oct. 9, 1996

[51] Int. Cl.[6] ..... H01T 13/20

[52] U.S. Cl. ..... 313/141; 313/143; 123/169 EL

[58] Field of Search ..... 313/141, 142, 313/118; 445/7; 123/169 EL, 169 R

[56] References Cited

U.S. PATENT DOCUMENTS

| | | | |
|---|---|---|---|
| 2,120,492 | 6/1938 | Graf | 313/142 |
| 2,314,128 | 3/1943 | Coldwell | 313/141 |
| 4,268,774 | 5/1981 | Forkum, Jr. | 313/141 |
| 5,373,214 | 12/1994 | McCready | 313/142 |
| 5,461,210 | 10/1995 | Matsutani et al. | 445/7 |
| 5,650,687 | 7/1997 | van den Bogaert | 313/141 |

*Primary Examiner*—Sandra L. O'Shea
*Assistant Examiner*—Michael Day

[57] ABSTRACT

A cambered shape of an external negative electrode (11) of an internal combustion engine's spark plug so that a spark bridging the plug's spark gap (17) impinges first at the base region (14) and travels outward and around to initiate burn of almost 100% of available fuel. The cambered shape culminates with an end section (16) that is ¼ of a sphere and has symmetry to the radial edge of a center electrode (13).

1 Claim, 5 Drawing Sheets

EXTERNAL NEGATIVE ELECTRODE HAVING A CAMBERED SHAPE

BACKGROUND—FIELD OF INVENTION

The present invention generally relates to spark plugs for igniting the fuel charge in an internal combustion engine and is particularly concerned with an improved construction of the external negative electrode which substantially improves gasoline mileage and significantly reduces exhaust pollution and plug-fouling carbon buildup as compared with known prior plug art.

BACKGROUND—DESCRIPTION

The present invention relates only to the external negative electrode of a spark plug for an internal combustion engine.

In conventional internal combustion engine spark plugs of the type currently in widespread use, the external negative electrode terminates in a single (or more) arm or gap-defining end portion which extends radially of the plug's center electrode at a region where it is spaced axially from the end of the center electrode and is intersected by the center electrode's longitudinal axis. Although such spark plugs work satisfactorily, they nevertheless leave considerable room for improvement.

There is no prior art like this invention. The external negative electrode of prior art are all of a four-sided configuration of some sort whether a rectangle, trapezoid or wedge. The configuration of this invention specifically improves combustion to almost 100% burn therefore almost eliminating some harmful gas emissions and will be explained hereunder.

OBJECTS AND ADVANTAGES

The objects and advantages of my electrode modification are:

(a.) to address the problem of combustion inefficiency once and for all. This new shape allows the spark to travel around the whole external negative electrode burning almost 100% of the fuel in every combustion event and leaving very little residue, therefore almost eliminating carbon (build-up and ultimate fouling of the plug) and carbon monoxide emissions are almost eliminated as well.

(b.) to improve performance of engines using this invention by producing more horsepower, more torque, reducing engine and transmission wear, extending the life of starter motors, starting quicker, running smoother, accelerating better, saves gas, runs quieter, tune-ups last longer, extending the life and increasing the value of older cars engines because of the aforementioned advantages and benefits.

Nothing currently available can do all of the above to the degree that this invention does. But more specifically, nothing currently available can reduce exhaust gas emissions from incomplete combustion like this modification does.

Two small dirt bikes were observed in July 1994 traveling a small oval track through backyard woods, driven by experienced, adult riders. One bike had a two-stroke engine and the other one had a four-stroke engine. There was one small knoll (1 foot high) that they rode up and over dozens of times with the wheels never able to leave the ground.

When the modification was applied to the bike with the two-stroke engine and when the first driver went over the knoll, not only did the bike jump off of it, but because of the unexpected, additional power, the driver lost control of the bike and jumped off as it flew away from him and landed some distance away and flipped over several times from the dramatically increased power.

The second driver had to try the modified bike and the results were the same. He had to let it fly out from under him when it went over the knoll because he couldn't control it. The third driver had to try it also but was able to control it because he was now aware of the additional power available. No other changes were made. The modified external negative electrode was the only change made to cause this effect.

Cars that have been using this modification typically show from 2–6 mpg gas savings. If a sample car went 100 miles before the modification, it can now go 130 miles on the same amount of gas at a 3 mpg improvement; ergo if it went 1000 miles before the modification, it can now go 1300 miles on the same amount of gas; ergo if it went 5000 miles before the modification, it can now go 6500 miles on the same amount of gas.

If a car originally goes 100,000 miles, it will now go 130,000 miles on the same amount of gas.

The modification was developed at the Cleveland Stadium on leaf blowers that used two-cycle engines to clean the stadium after public events. The engines were originally fouling-out very frequently. The engine breakdowns were due to carbon, oil and grease fouling the plugs which disrupted the stadium-cleaning process constantly. As a result of my studying the combustion problem, I modified the external negative electrode enough to stop the fouling problem dramatically. The ultimate result was that the crew of 40 people cleaned the stadium a day sooner than it usually took . . . a large money and time saver. It was like hiring 13 more people but in reality, it was increased productivity and reliability of the machines because of approximately ⅓ more output in power.

A 1989 Ford Aerostar mini-van using this modification, with over 100,000 miles on it, continued for the second year in a row (1995) to pass the State of Ohio Automobile Inspection and Maintenance test required for license plate renewal with significant results:

HC 75 (max allowed 220); CO 0.02% (max allowed 1.2%); $CO_2$ 15.1%

In 1994 at a stock car race, the partially-fouled, used, Splitfire spark plugs on one of the race cars were modified before the race. After the race, the plugs were inspected. Not only was there no carbon build-up, but the carbon that had been there because they were used previously was also gone . . . the modification not only prevented carbon build-up, but it also burned the old carbon that was there. They cleaned themselves in the course of the race.

Cars using regular gas of 89 octane can now use 86 octane without engine knock because of the new standard of combustion efficiency that the modification offers. Less refined gasoline such as 86 octane can now be utilized without an increase in exhaust gas emission pollutants.

Further objects and advantages of my electrode modification will become apparent from a consideration of the drawings and ensuing description.

DESCRIPTION OF DRAWINGS FIGURES

REFERENCE NUMERALS IN DRAWINGS

Figure 1:
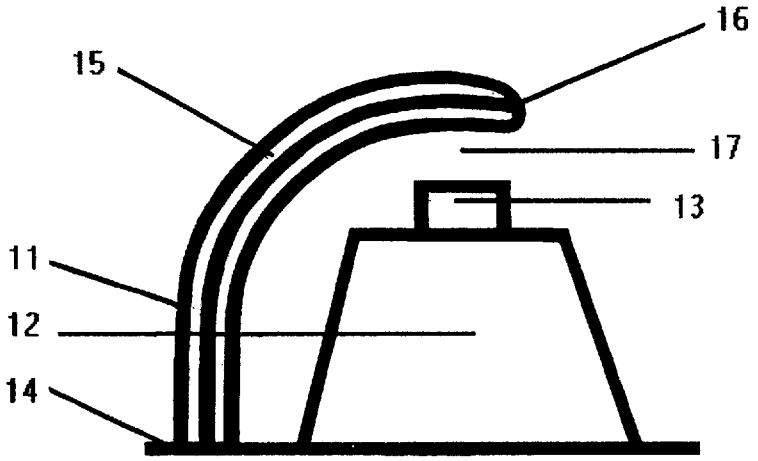
FIG. 1 is a side view of a spark plug end incorporating the principles of my modification.

11 External negative electrode or ground electrode
12 Insulating core or sleeve
13 Center electrode
14 Metal shell or housing
15 Depending portion
16 End section
17 Spark gap
18 Rounded edge

DESCRIPTION—FIGS. 1 TO 5

Except for the external negative electrode or ground electrode (indicated at 11 in the drawings) the internal combustion engine spark plug (not shown) incorporating the principles of this modification is conventional and mainly comprises a straight, longitudinally extending center electrode 13 peripherally surrounded by a porcelain insulating core 12 which is mounted in a metal shell or housing 14. At the gap-defining ends of the electrodes 11 and 13, housing 14 has a rim or skirt which is externally threaded for mounting in an engine block in the usual manner.

As shown, center electrode 13 may be cylindrical and projects at its gap-defining end beyond the insulating core 12. The external negative electrode 11 is suitably joined to and depends from the threaded housing 14. External negative electrode 11 is bent in the usual manner to form a depending portion 15 extending parallel to center electrode 13 and culminating with end section 16. End section 16 lies at least generally in a plane normally intersecting the longitudinal axis of center electrode 13 and additionally lies radially with respect to the longitudinal axis of center electrode 13. End section 16 is axially spaced from the near end of center electrode 13 to define therewith the spark plug gap which is indicated at 17.

Figure 2:
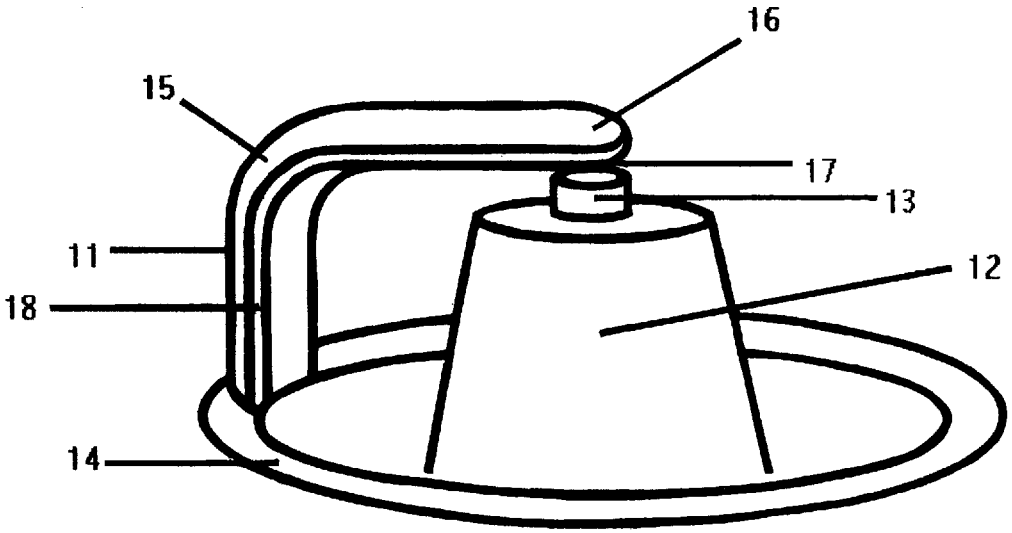
FIG. 2 is a skewed view of the spark plug end shown in FIG. 1 incorporating the principles of my modification which better shows the cambered shape of the external negative electrode.
Figure 3:
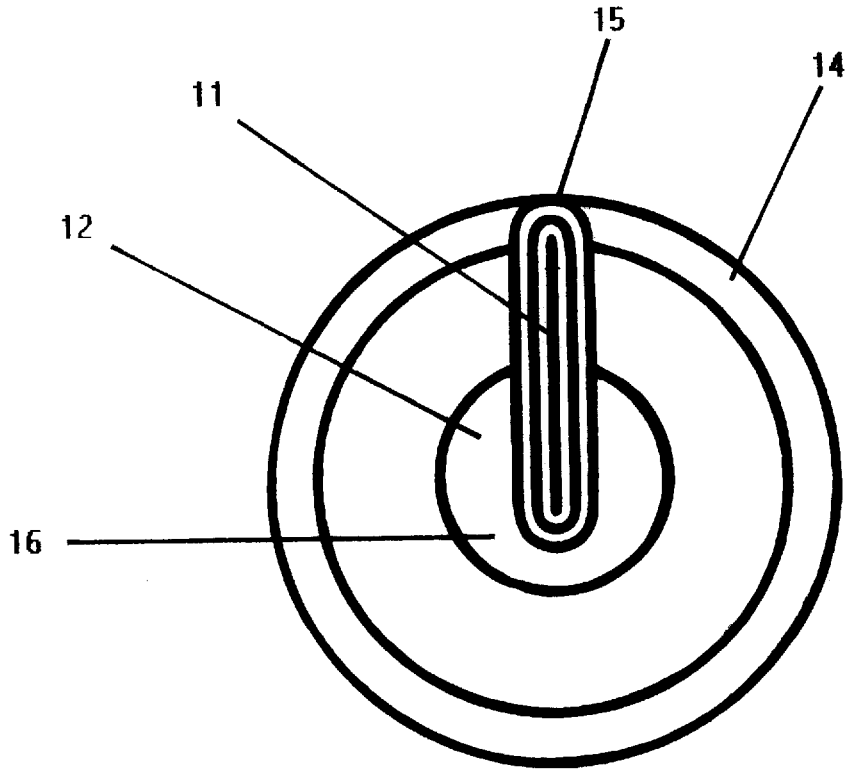
FIG. 3 is a top view of the spark plug end shown in FIG. 1 incorporating the principles of my modification.
Figure 4:
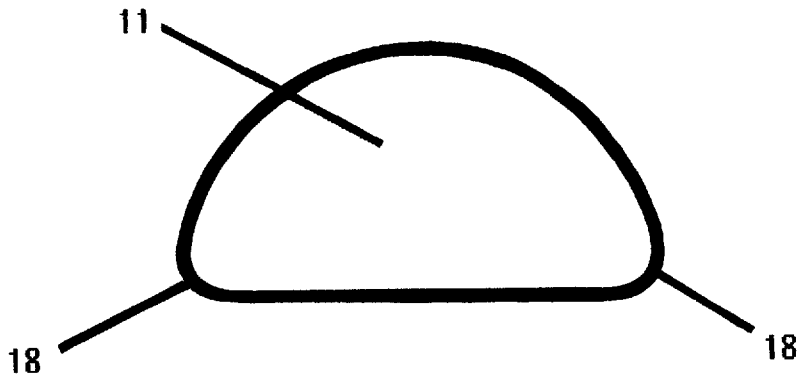
FIG. 4 is a crosscut view of the external negative electrode incorporating the cambered shape of my modification.
Figure 5:
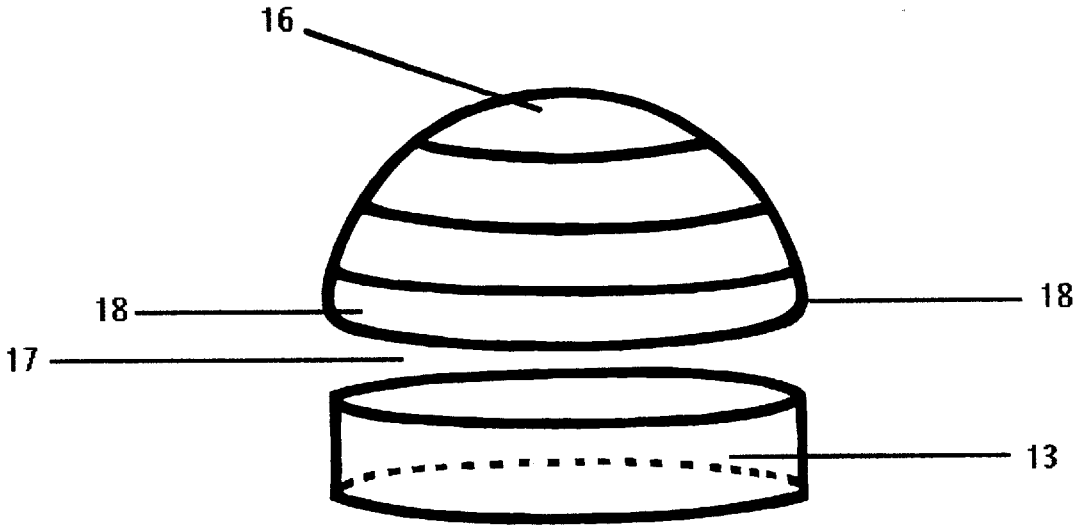
FIG. 5 is a front end view of the end section of the external negative electrode shown appropriately above the center electrode.

As best shown in FIGS. 1–3 the external negative electrode 11 is cambered from the metal housing 14 to the end section 16. End section 16 is ¼ sphere-shaped and has symmetry to the radial edge of the center electrode 13.

SUMMARY OF INVENTION

A new shape of my electrode modification draws the spark event around the external negative electrode, burning all available fuel. This includes the fuel behind the external negative electrode which addresses the shadow area never before addressed from which incomplete combustion has emanated until now. This typical shadow area of most prior art holds fuel that doesn't get burned. This creates harmful emissions. It has been shown in my concept theory that the area behind the external negative electrode is where combustion is least efficient. This modification eliminates this flaw once and for all.

Conclusion, Ramifications, and Scope of Invention

Thus the reader will see that a spark plug with the modified external negative electrode of this invention will have a major impact on an engine's performance with many benefits and results, the most important being the environmental impact of minuscule harmful CO emissions as compared to prior art.

While my above description contains many specificities, these should not be construed as limitations on the scope of the invention, but rather as an exemplification of one preferred embodiment thereof. Many other variations are possible. The invention is remarkable when used on any internal combustion engine. Results are most dramatic on two-stroke engines and therefore relevant to the new government standards for these engines.

The new government standards for small engines' exhaust gas emissions is addressed by this modification. This modification goes a long way in helping small engine manufacturers meet the new standards. This product is more dramatic on two-cycle engines because they are notoriously the worse pollutant producers. This modification goes farther than any other engineering attempt so far in reducing pollutants.

Accordingly, the scope of the invention should be determined not by the embodiment(s) illustrated, but by the appended claims and their legal equivalents.

I claim:

1. A spark plug for an internal combustion engine with an improved ground electrode includes a distal end portion that is a quarter of a sphere in shape; and a cross section of the ground electrode, parallel to the axis of the spark plug, is approximately semicircular having a cambered first surface, and a flat second surface; wherein, the flat second surface faces a center electrode of the spark plug.

* * * * *